United States Patent [19]

Shinagawa

[11] Patent Number: 4,660,903

[45] Date of Patent: Apr. 28, 1987

[54] TEMPERATURE CONTROLLED DISPLAY CASE

[75] Inventor: Katsumi Shinagawa, Isesaki, Japan

[73] Assignee: Sanden Corporation, Gunma, Japan

[21] Appl. No.: 750,268

[22] Filed: Jul. 1, 1985

[30] Foreign Application Priority Data

| | | | |
|---|---|---|---|
| Jun. 29, 1984 | [JP] | Japan | 59-97908[U] |
| Jun. 29, 1984 | [JP] | Japan | 59-97909[U] |
| Aug. 20, 1984 | [JP] | Japan | 59-126086[U] |

[51] Int. Cl.[4] ..... A47F 3/04

[52] U.S. Cl. ..... 312/116; 312/140; 312/31

[58] Field of Search ..... 312/31, 31.03, 31.02, 312/114, 138, 140, 116; 403/171, 172, 231, 176, 219; 52/589, 595, 275, 288, 275, 404

[56] References Cited

U.S. PATENT DOCUMENTS

| | | | |
|---|---|---|---|
| 760,805 | 5/1904 | Paulle | 312/140 |
| 1,269,839 | 6/1918 | Morris | 312/140 |
| 3,468,089 | 9/1969 | Saunders et al. | 52/275 |

FOREIGN PATENT DOCUMENTS

| | | | |
|---|---|---|---|
| 939848 | 11/1948 | France | 52/404 |

*Primary Examiner*—William F. Pate, III
*Assistant Examiner*—Joseph Falk
*Attorney, Agent, or Firm*—Banner, Birch, McKie & Beckett

[57] ABSTRACT

A refrigerated display case with front, top and side panels of multi-windowpane construction. Each panel is designed to provide high visibility of the merchandise on display. The panels are easily connected together. Thus, the manufacturing cost of the display case is significantly reduced.

7 Claims, 9 Drawing Figures

TEMPERATURE CONTROLLED DISPLAY CASE

BACKGROUND OF THE INVENTION

This invention generally relates to the field of merchandise display cases, and more particularly, is directed to a temperature controlled display case with increased visibility of the merchandise on display.

In conventional temperature controlled display cases, such as those used to display frozen or perishable foodstuff, the transparent portion of the case is usually made of an insulative multi-windowpane structure which is interposed between a colder region and a warmer region. In a refrigerated display case, the purpose of the multi-windowpane structure is to insulate the colder inside region from the warmer outside region in order to conserve the amount of energy required to operate the refrigerations system and to prevent the formation of condensation on the window structure.

With reference to FIGS. 1 and 2, a conventional refrigerated display case will be described. As shown in FIG. 1, the refrigerated display case (generally indicated by reference No. 1) comprises a display chamber 5 mounted on a refrigeration unit 2. Chamber 5 is maintained at a prescribed temperature by refrigeration unit 2 and is comprised of a front side window 3*a*, right and left side windows 3*b*, 3*c*, top window 3*d* and door 4. Door 4 is rotatably supported on chamber 5 so as to permit ready access to the interior of chamber 5. Side and top windows 3*a*, 3*b*, 3*c* and 3*d* are of multi-windowpane construction as shown in more detail in FIG. 2. As shown in FIG. 2, each side and top window comprises outside windowpane 5*a* and inside windowpane 5*b* with spacer 5*c* therebetween. The side and top edges of the respective windowpanes are attached together with fastening means 6. Fastening means 6 includes element 6*a* which is formed with a plurality of supporting projections 8 for shelves 7, metallic reinforcement element 6*b* and an accessory element 6*c* which improves the outer appearance of fastening means 6 and prevents the user from being injured from sharp corners on the display case.

In the conventional display case, as shown in FIGS. 1 and 2, fastening means 6 for attaching together the respective edges of the top and side windowpane structures consists of a plurality of component parts. Therefore, the assembly of the display case is quite complicated and time-consuming. Moreover, each corner of the display case is covered by a metallic accessory element or fastening device which reduces the visibility of the merchandise stored in the display case. Accordingly, there is a need in the art for a display case which overcomes these disadvantages.

SUMMARY OF THE INVENTION

It is, therefore, the overall object of the present invention to provide a display case which can be readily assembled by simple fastening means.

It is a specific object of the present invention to provide a display case which affords good visibility of the merchandise maintained in the display case.

It is another object of the present invention to provide a display case with the above advantages without significant modification of the multi-windowpane construction.

A temperature controlled display case with multi-windowpane construction in accordance with the present invention includes a refrigerated chamber which holds merchandise for display. The refrigerated chamber is cooled by a refrigeration unit and includes a front side window, right and left side windows, a top window and a door. Each of the windows is of multi-windowpane construction which includes an inside glass windowpane and an outside glass windowpane. A transparent spacer is disposed between the inner and outer windowpanes to define a space therebetween. The outer windowpane of either the right, left or front sides of the case has an enlarged portion which covers a side surface of an opposed windowpane. The enlarged portion is fixed on the side surface of the opposed windowpane with fastening means.

These and other objects of the present invention will be understood from the following detailed description of the preferred embodiment with reference to the annexed drawings.

DETAILED DESCRIPTION OF THE PREFERRED EMBODIMENTS

Figure 1:
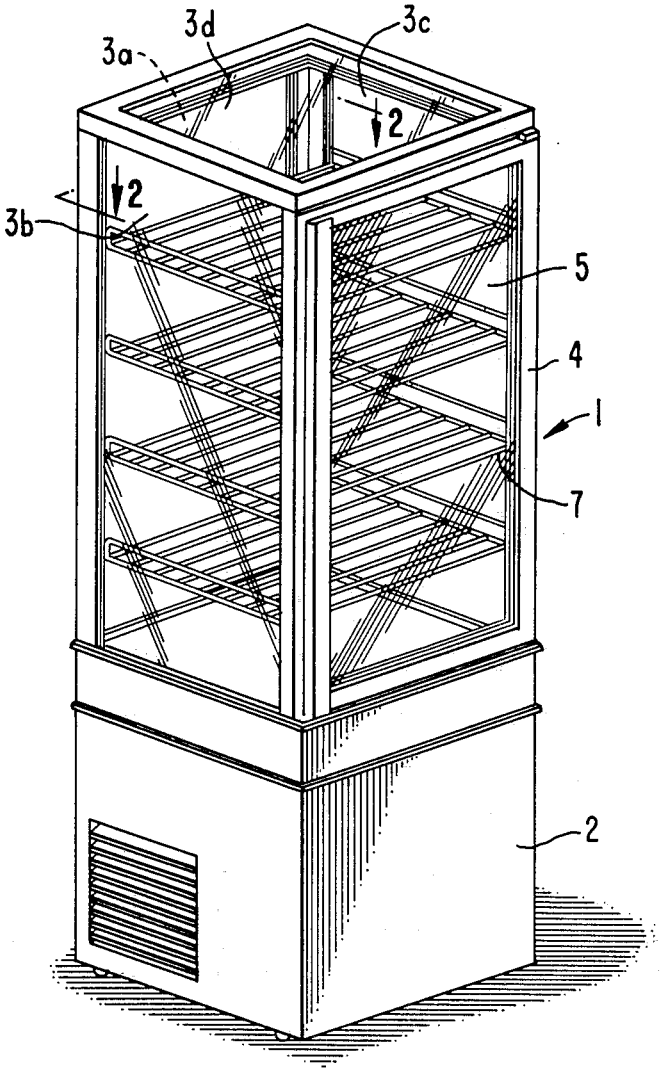
FIG. 1 PRIOR ART
FIG. 1 is a perspective view of a refrigerated display case known in the prior art.
Figure 2:
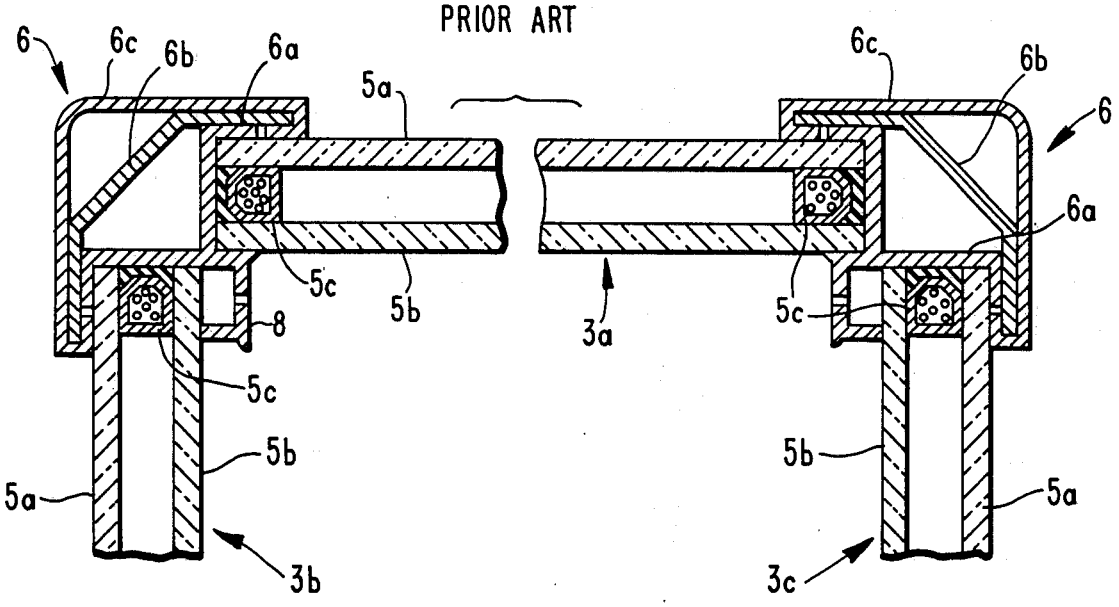
FIG. 2 PRIOR ART
FIG. 2 is a cross-sectional view taken along line 2—2 of FIG. 1.
Figure 3:
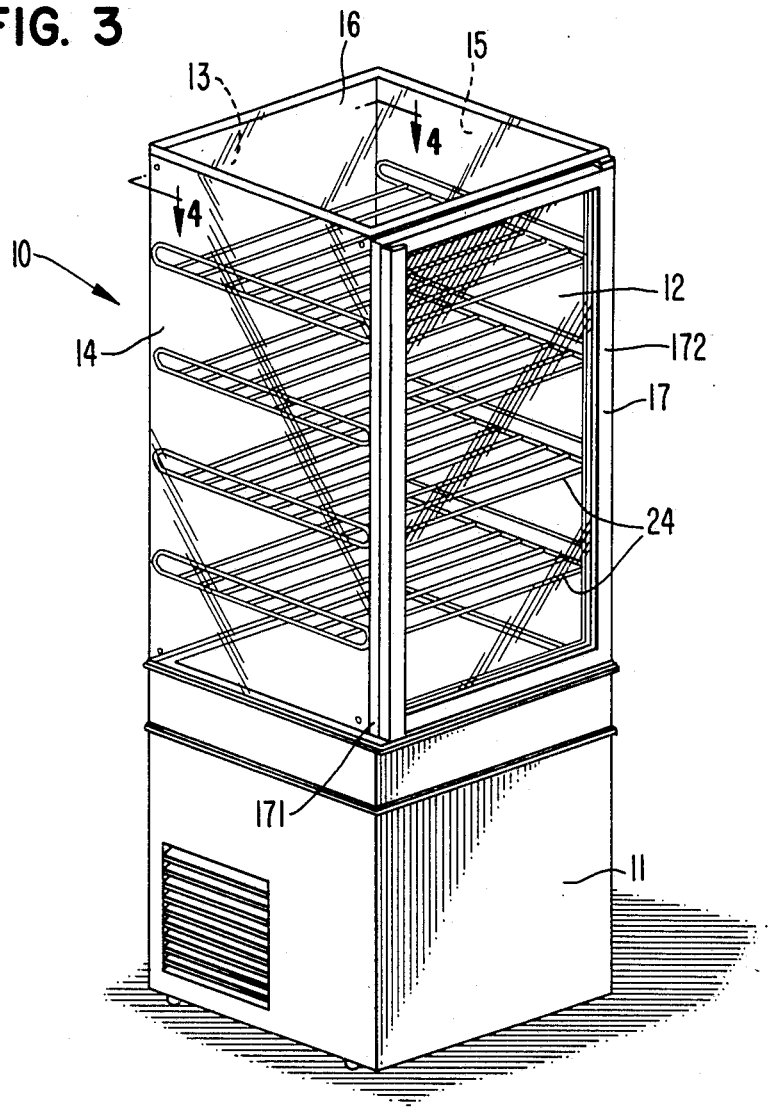
FIG. 3 is a perspective view of a refrigerated display case in accordance with the present invention.
Figure 4:
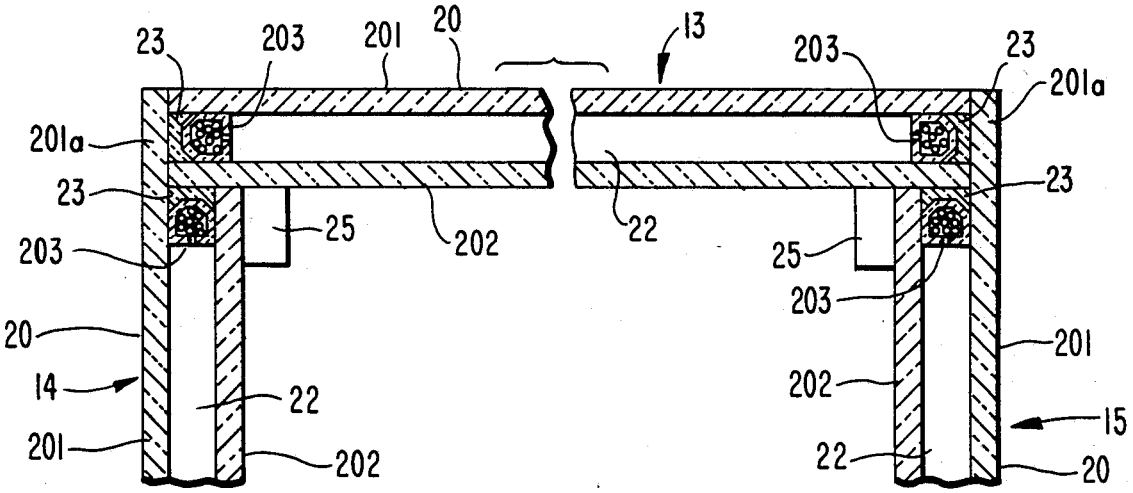
FIG. 4 is a cross-sectional view taken along line 4—4 of FIG. 3.

Referring to FIGS. 3 and 4, a refrigerated display case in accordance with one embodiment of the present invention is shown. The display case is generally indicated by reference No. 10 and includes a mechanical chamber 11, within which a refrigeration unit is disposed, and a merchandise display chamber 12 which is placed above mechanical chamber 11 and is maintained cool by the refrigerator unit.

Display chamber 12 is defined by front side window 13, right and left side windows 14 and 15, top window 16 and hinged door 17. Door 17 comprises frame element 171 and clear window element 172. Frame element 171 is attached to the rear side edges of top, right and left windows 14, 15 and 16 to defined a rear opening for ready access to chamber 12. Sealing of the rear opening with respect to door 17 is accomplished by a seal element disposed between frame element 171 and window element 172 as is known in the art.

As shown in FIG. 4, front, left and right windows 13, 14 and 15 are of multi-windowpane construction as generally indicated by reference No. 20. Each window comprises an outer side glass 201 outwardly facing a warmer region, an inner side glass 202 inwardly facing display chamber 12 and spacer 203 which is formed of transparent material and is disposed between the outer peripheral edge of inner and outer glasses 201, 202 to form a gap 22 therebetween. Gap 22 is sealed off by seal element 23 formed of transparent material. Therefore, cooling efficiency of the refrigeration unit is greatly improved while at the same time the formation of condensation on the display case windows is prevented.

A plurality of shelves 24 are disposed within display chamber 12. Shelves 24 may be supported, respectively, on a plurality of supporting elements 25 attached to an inner surface of the inner glass of each window.

Figure 5:
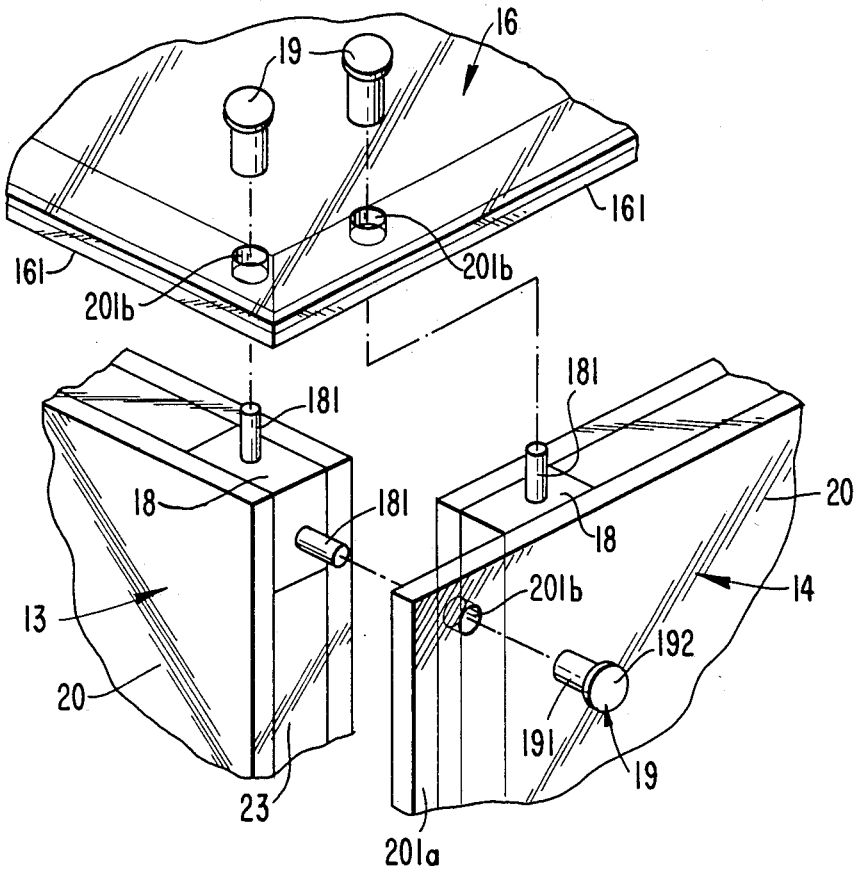
FIG. 5 is an exploded perspective view illustrating the connecting means used to connect the side and top panels of the display case in accordance with the present invention as shown in FIG. 3.
Figure 6:
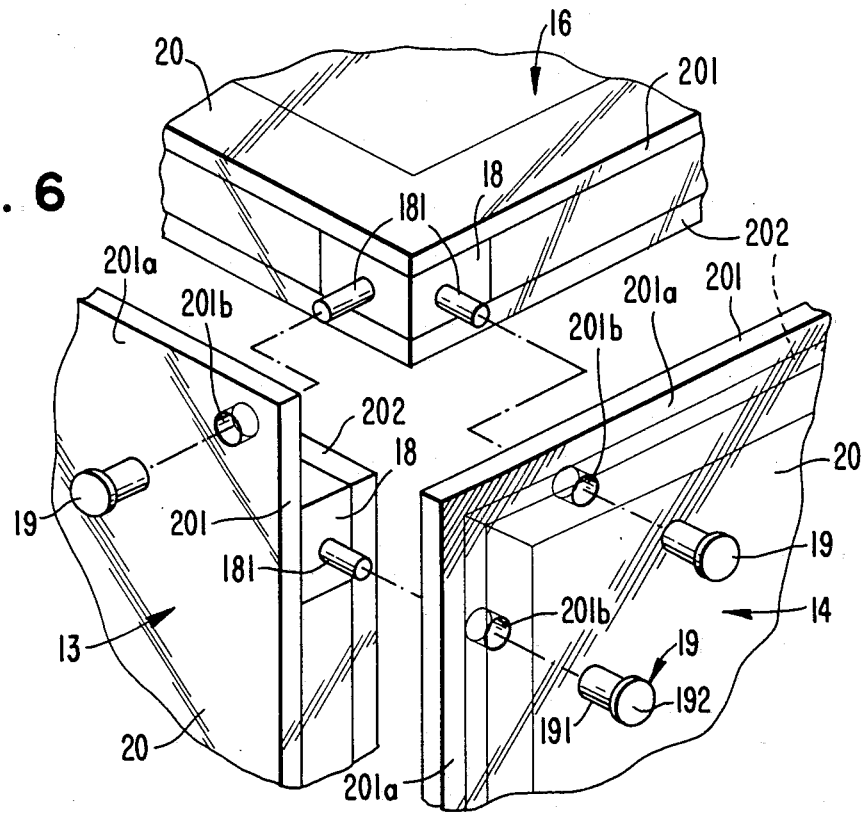
FIG. 6 is an exploded perspective view showing another embodiment of the connecting means used to connect the top and side panels of the display case of the present invention.

In the display case shown in FIGS. 4 and 5, outer glass 201 of front and side windows 13, 14, 15 have and extended portion 201*a* which completely covers the front and side edges 161 of top window 16 as shown in FIGS. 4 and 5. Where top window 16 is also of multi-windowpane construction as shown in FIG. 4, outer glass 201 of top window 16 is formed with an extended portion which covers the top edge of front and side windows 13, 14 and 15.

As shown in FIG. 5, coupling elements 18, which have an L-shaped cross-section, are disposed in each corner of front, right and left side windows 13, 14 and 15 between inner and outer glasses 201, 202. A drying element or agent may be inserted in coupling elements 18 for treating the air trapped inside gap 22. Alternatively, a drying element or agent may be enclosed in both terminal ends of spacer 203. Pins 181 are formed on a side surface of coupling element 18. Pins 181 engage respective holes 201*b* and are held in position by fastening elements 19. Fastening elements 19 comprises a cylindrical portion 191, in which a correspond pin 181 is closely fitted, and a head portion 192 which seats against the outer surface of extended portion 201*a* of the windows. Each of windows 13, 14, 15 and 16 is thus connected with one another through coupling elements 18 and corresponding fastening elements 19. Coupling elements 18 and fastening elements 19 may be held together by a variety of fastening techniques such as by compression fitting, adhesives or by threading.

Where top window 16 is of multi-windowpane construction as shown in FIG. 4, outer glass 201 of front and side window 13, 14 and 15 have an extended portion 201*a* which covers the side edges of top window 16. Coupling elements 16 are also disposed in each corner of top window 16. Thus, top window 16 is connected to front and side windows 13, 14 and 15 in the manner shown in FIG. 5.

Figure 7:
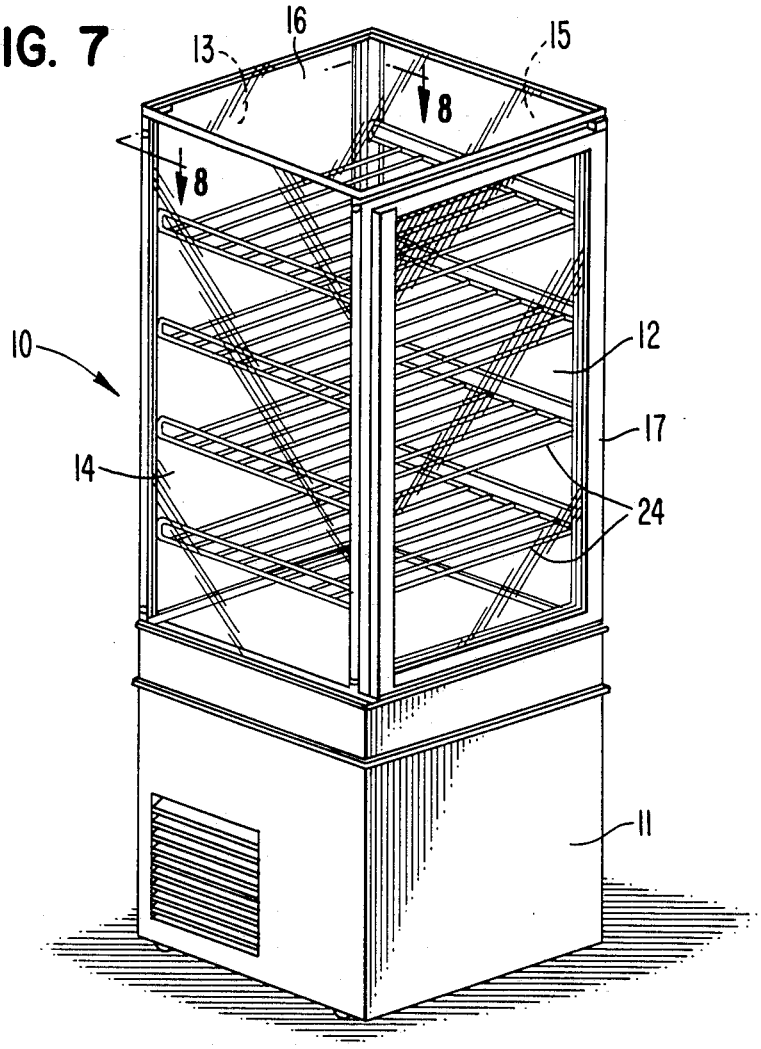
FIG. 7 is a perspective view of a refrigerated display case in accordance with another embodiment of the present invention.
Figure 8:
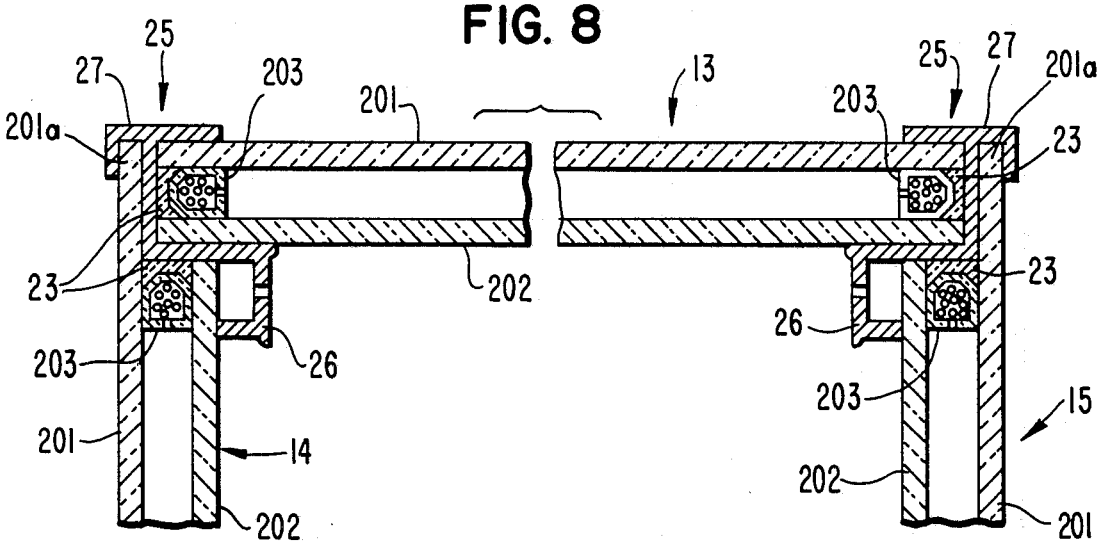
FIG. 8 is a cross-sectional view taken along line 8—8 of FIG. 7.
Figure 9:
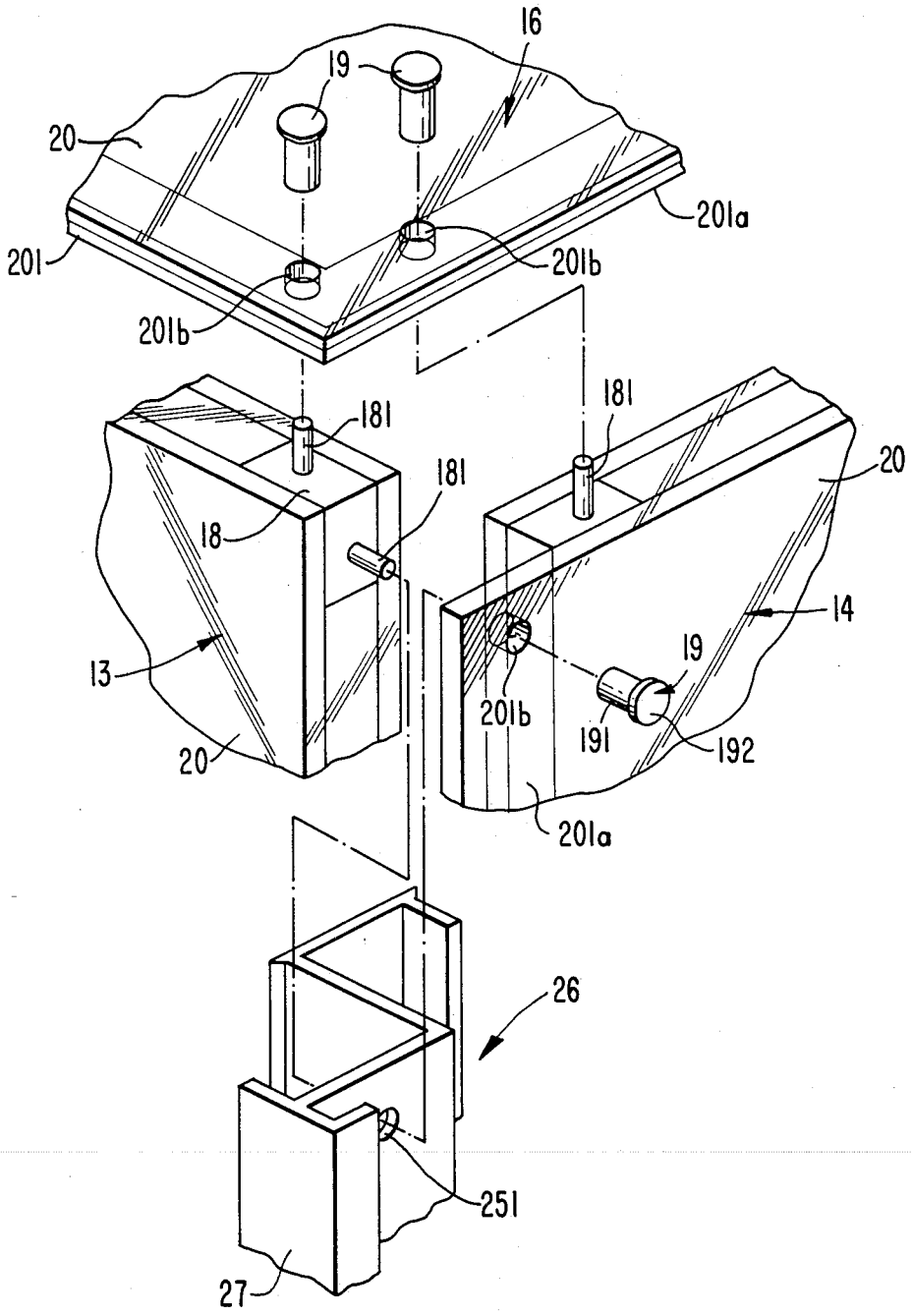
FIG. 9 is an exploded perspective view showing the connecting means used to connect the top and side panels of the display case shown in FIG. 7.

FIGS. 7, 8 and 9 illustrate another embodiment of the connecting system shown in FIG. 3. Therefore, parts similar to those shown in FIGS. 3–5 are indicated by the same reference number. Outer glass 201 of front window 13 and side windows 14, 15 have an extending portions 201*a* which covers the side surface of an opposed window. A connecting member 25 which has a L-shaped cross-section is placed respective, between right and left windows 14, 15 and front window 13. Therefore, a side surface of windows 13, 14 and 15 is covered by a portion of connecting member 25. Each connecting member 25 is fixed on the respective windows by coupling elements 18 and corresponding fastening elements 19. Thus, connecting member 25 is formed over a hole 251 which permits penetrationof pin 181 of coupling elements 18 and cylinder portion 191 of fastening elements 19.

A plurality of shelf supporting elements 26 which support shelves 24 in display chamber 12 are located on an inner side edge of connecting member 25 and may be integrally formed with connecting member 25. Accessory portion 27 may also be integrally formed with an outer edge of connecting member 25 and has flange portion 271 which covers the outer edge of extended portion 201*a* of each window. Flange portion 271 prevents the outer edge of the windows from causing injury or damage and provides reinforcement for coupling element 18 and fastening elements 19.

This invention has been described in detail in connection with preferred embodiments. The embodiments, however, are merely for example only and the present invention is not restricted thereto. It will be easily understood by those skilled in the art that other variations and modifications can easily be made within the scope of this invention, as defined by the appended claims.

I claim:

1. In a refrigerated display case including a mechanical chamber in which a refrigeration unit is disposed and a refrigerated chamber for the display and storage of merchandise, said refrigerated chamber cooled by said refrigeration unit and being defined by a front window, right and left side windows, and a top window, said front, left and right side windows and said top windows attached together along their contiguous edges, the improvement comprising:

said front, left and right windows of multi-windowpane construction, said construction including inner and outer glass panels;

a transparent spacer, positioned between said inner and outer glass panels for holding said panels in spaced parallel relation, said spacer positioned along the outer peripheral edge portion of said inner and outer glass panels to form an air gap therebetween, said outer glass panel of said side windows having an extended portion for engaging the edge surfaces of an adjacent window,; and fastening means for fixing said extended portion on said edge surface.

2. The refrigerated display case of claim 1 wherein said top window is of multi-windowpane construction.

3. The refrigerated display case of claim 2 wherein an upper edge of said outer glass panel of said front window and said right and left windows have an extended portion for covering the edge surfaces of said top window, and fastening means for fixing said extended portion to said edge surface of said top window.

4. The refrigerated display case of claim 2 wherein the outer peripheral edge of said outer glass panel of said top window has an extended portion for covering the upper edge surfaces of said front window and said left and right side windows and fastening means for fixing said extended portion to said edge surfaces.

5. The refrigerated display case of claim 1 wherein a connecting member is located on the connecting portions defined by the edge surfaces of said opposed windows, said extended portion of said outer glass panel and said inner glass panel of said opposite window, fastening means for fixing said connecting member on said opposed window.

6. The refrigerated display case of claim 1 wherein said fastening means comprises a coupling member which is disposed on each corner of said windows, said coupling member includes a pin which is received in a hole formed through said extended portion of said outer glass and a fastening element affixed on an end portion of said pin.

7. The refrigerated display case of claim 6 wherein said coupling member has an L-shaped cross-section and includes a cavity within which is received a drying material.

* * * * *